United States Patent [19]

Mallory et al.

[11] 4,407,869

[45] Oct. 4, 1983

[54] CONTROLLING BORON CONTENT OF ELECTROLESS NICKEL-BORON DEPOSITS

[75] Inventors: Glenn O. Mallory, Los Angeles, Calif.; Theresa R. Horhn, Detroit, Mich.

[73] Assignee: Richardson Chemical Company, Des Plaines, Ill.

[21] Appl. No.: 449,223

[22] Filed: Dec. 13, 1982

Related U.S. Application Data

[63] Continuation of Ser. No. 295,523, Aug. 24, 1981, abandoned.

[51] Int. Cl.[3] ..... C23C 3/02

[52] U.S. Cl. ..... 427/443.1; 106/1.27; 106/1.22; 427/438

[58] Field of Search ..... 106/1.27, 1.22; 427/438, 443.1

[56] References Cited

U.S. PATENT DOCUMENTS

| | | | |
|---|---|---|---|
| 3,062,666 | 11/1962 | McLeod et al. . | |
| 3,310,430 | 3/1967 | Schneble, Jr. | 106/1.23 |
| 3,946,126 | 3/1976 | Feldstein | 106/1.27 |
| 4,019,910 | 4/1977 | Mallory | 427/438 |
| 4,139,660 | 2/1979 | Tur . | |
| 4,151,311 | 4/1979 | Feldstein . | |
| 4,167,416 | 9/1979 | Zolla | 427/438 |
| 4,259,376 | 3/1981 | Feldstein . | |

FOREIGN PATENT DOCUMENTS

| | | |
|---|---|---|
| 1198167 | 11/1959 | Fed. Rep. of Germany . |
| 1360592 | 2/1973 | United Kingdom . |
| 2066857A | 1/1980 | United Kingdom . |

OTHER PUBLICATIONS

Mallory, "The Electroless Nickel-Boron Plating Bath; Effects of Variables on Deposit Properties" Plating, Apr. 1971, pp. 319-327.

"Zirconium Compounds", vol. 22, p. 643.

*Primary Examiner*—John D. Smith

*Attorney, Agent, or Firm*—Lockwood, Dewey, Alex & Cummings

[57] ABSTRACT

The boron content of an electroless nickel-boron deposit is enhanced by including a source of zirconyl ions or vanadyl ions within a borane-reduced bath for laying down the nickel-boron deposit, which bath has a moderate temperature and pH. The deposit laid down has a boron content of at least about 2 weight percent, based on the total weight of the deposit.

24 Claims, No Drawings

CONTROLLING BORON CONTENT OF ELECTROLESS NICKEL-BORON DEPOSITS

This is a continuation of application Ser. No. 295,523, filed Aug. 24, 1981 now abandoned.

BACKGROUND OF THE INVENTION

This invention generally relates to electroless nickel-boron deposits having a high boron content. More particularly, the baths utilized are borane-reduced baths that are at a relatively low pH and a relatively low temperature, which baths deposit a high percentage of boron by including therewithin a source of zirconyl ions and/or vanadyl ions.

It has long been known that an electroless codeposit of nickel and boron is achieved by immersion of a substrate into an electroless bath including a source of nickel ions and a borane reducing agent. Often, it is desirable to lay down a deposit that has a relatively high boron content in order to enhance the hardness of the deposit when compared with a substantially pure nickel deposit of up to 99.9 percent nickel. Traditionally, however, borane-reduced baths form a codeposit that is severely limited relative to the ability to control the percentage of boron that could be laid down in the codeposit, borane-reduced baths being especially unsuitable for forming codeposits having a relatively high boron content on the order of 2 weight percent and above. These borane-reduced deposits are limited generally by the pH of the bath and the stability of the borane reducing agent of the bath.

More particularly, as the pH of a borane-reduced bath is decreased, the percentage of boron codeposited with the nickel is increased; however, because boranes undergo hydrolysis at low pH values, borane reducing agents begin to lose their stability and thus are rapidly consumed as the bath pH is reduced below 4. A borane-reduced electroless nickel bath that will lay down a deposit having a high boron content would have to be at a low pH, but a low pH bath consumes the borane reducing agent at an excessive rate that is unacceptable commercially. Therefore, while the boron content of borane-reduced codeposits could be increased by decreasing the pH, this capability is limited by the fact that the boranes are consumed at rates that are unacceptable commercially when the pH is lowered to a level that produces a high-boron codeposit. Generally, a borane-reduced bath that is commercially viable from the point of view of acceptable levels of borane consumption should have a pH well in excess of 5.

It is known that the boron content of nickel-boron electroless deposits can be increased by the use of a borohydride ion as the reducing agent in the bath rather than a borane reducing agent, but borohydride-reduced baths lay down high-boron deposits only when such baths are operated at a pH of over 13 and at a temperature in excess of 90° C. These are relatively harsh conditions that are undesirable to maintain in a commercial electroless plating operation. But, if a borohydride-reduced bath is allowed to drop to a pH of below about 12, the bath undergoes spontaneous solution decomposition.

By the present invention, there has been discovered a manner of achieving what is recognized as a high boron percentage of in excess of about 2 percent boron of an electroless nickel-boron deposit from a borane-reduced electroless deposition bath and that avoids the use of the borohydride ion and avoids the high pH and high temperature conditions associated therewith. Baths according to this invention are borane reduced and have operating conditions that include a relatively moderate temperature and a moderate pH. Such baths according to this invention include a source of zirconyl ions and/or vanadyl ions within a borane-reduced bath.

It is accordingly a general object of the present invention to provide improved electroless nickel plating.

Another object of this invention is to provide an improved electroless nickel bath, product and method that are characterized by a nickel-boron codeposit having a relatively high boron content.

Another object of this invention is an improved electroless nickel deposition bath that incorporates a borane reducing agent and that lays down a deposit having a relatively high weight percentage of boron.

Another object of the present invention is an improved electroless deposition system wherein a bath having a moderate pH and a relatively moderate temperature lays down a nickel-boron codeposit having a boron content in excess of on the order of 2 weight percent.

Another object of this invention is an improved electroless bath for deposition of a nickel deposit having a hardness that is enhanced over that of a substantially pure electroless nickel deposit.

These and other objects of the present invention will be apparent from the following detailed description thereof.

According to the present invention, electroless nickel baths are provided that form a nickel-boron deposit onto a substrate, which baths include boron deposition enhancers such as zirconyl ions, vanadyl ions, or combinations thereof, together with a borane reducing agent and a source of nickel. Other typical electroless nickel bath ingredients may be included, such as complexing agents, stabilizers, buffers, and the like.

It is believed that the boron deposition enhancers impart added stability to the borane reducing agent in the bath while also enhancing its boron depositing capabilities at moderate pH values. Zirconyl ion boron deposition enhancers can be added to the bath by any compound that will liberate zirconyl ions ($ZrO^{++}$), such as zirconyl chloride octahydrate ($ZrOCl_2.8H_2O$). Vanadyl ion ($VO^{++}$) boron deposition enhancers can be provided by compounds such as vanadyl sulfate or vanadium oxysulfate ($VOSO_4.2H_2O$) or other vanadyl salts, as well as by vanadates such as sodium metavanadate ($NaVO_3.4H_2O$), which vanadates oxidize organic compounds within the bath and in turn themselves undergo reduction to provide vanadyl ions within the bath.

Boron deposition enhancers are included within baths at a concentration having a lower limit of that at which the particular enhancer increases the boron deposit percentage and an upper limit guided by economic and bath solubility considerations. The enhancers are included in baths according to this invention at a concentration of at least about 0.0005 mol per liter. A typical concentration of the boron deposition enhancer within the bath is at least about 0.0005 mol per liter, preferably at least about 0.0007 mol per liter, and most preferably at least about 0.001 mol per liter. Usually, there is no need to include these boron deposition enhancers at bath concentrations in excess of 0.5 mol per liter, preferably not greater than 0.1 mol per liter.

Borane reducing agents utilized in baths according to this invention include any bath-soluble borane source such as ammine boranes, amine boranes, lower alkyl substituted amine boranes, and nitrogen-inclusive heterocyclic boranes including pyridine borane and morpholine borane. Generally, the alkyl amine boranes are preferred, especially dimethylamine borane. Reducing agent concentrations within these baths are those that are sufficient to effect adequate reduction and are also cost-efficient for reducing the nickel cations within the bath. Typical minimum concentrations are at least about 0.001 mol per liter of bath, more usually at least about 0.005 mol per liter, while as much as 1 mol per liter could be included, and usually no more than about 0.1 mol per liter need be included.

Sources of nickel for these baths are bath soluble nickel salts such as the sulfates, chlorides, sulfamates, or other anions compatible with electroless nickel systems. Concentrations utilized are those that are typical for electroless nickel plating baths, on the order of between about 0.001 mol per liter of bath and about 0.5 mol per liter.

As is the case for most electroless nickel baths, these baths will often include complexing agents, and almost any type of complexing agent is suitable and can be selected depending upon considerations such as availability, economics, and properties desired for the particular bath in addition to that of increased boron content of the deposit laid down by the bath. Complexing agents are, generally speaking, bath soluble carboxylic acids and bath soluble derivatives thereof, including hydroxy-substituted carboxylic acids, amino-substituted carboxylic acids, and bath soluble derivatives thereof including anhydrides, salts or esters that are bath soluble. Other complexing agents include ester complexes of polyhydric compounds formed by reacting an oxyacid with a polyhydric acid or alcohol such as those described in Mallory U.S. Pat. No. 4,019,910. Other complexing agents include pyrophosphoric acid and its derivatives as well as organo-phosphoric complexing agents including phosphonates.

Specific hydroxy substituted carboxylic acid complexing agents include citric acid, glycolic acid, lactic acid and malic acid, while exemplary amino-substituted carboxylic acid complexing agents include $\beta$-alanine, aminoacetic acid, aminodiacetic acid, and the amino acids such as $\alpha$-alanine, aspartic acid, glutamic acid, glycine, lucine, serrine, triosine, and valine. Complexing agents falling within the category of ester complexes of oxyacids and polyhydric acids or alcohols include ester complexes prepared by reacting an oxyacid with a carboxylic acid or alcohol compound which contains at least two hydroxy groups and from about 4 to about 15 carbon atoms per molecule. Typical suitable polyhydric compounds include carboxylic acids such as tartaric acid, gluconic acid or glucoheptonic acid, and alcohols such as mannitol, 2,3-butanediol and 1,2,3-propanetriol. The oxyacids used in forming the ester are generally inorganic acids such as boric, tungstic, molybdic or chromic acids. Usually, such ester complexes are in the form of a polyester that is an ester complex formed by reacting two or more mols of the oxyacid with one mole of the polyhydric compound.

Phosphonate complexing agents include aminotri(methylenephosphonic acid) and salts thereof such as a solution of the pentasodium salt of aminotri(methylenephosphonate), 1-hydroxyethylidene-1,1-diphosphonic acid and salts thereof such as the tridosium salt of 1-hydroxyethylidene-1,1-diphosphonic acid, ethylenediamine tetra(methylphosphonic acid) and salts thereof, and 1,6-diaminohexane tetra(methylphosphonic acid) and the alkaline metal and ammonium salts thereof.

Complexing agent bath concentration will, or course, be somewhat dependent upon whatever particular complexing agent or agents are included within the bath. Generally speaking, complexing agents within the bath are at a concentration of at least about 0.0005 mol per liter and can be as high as bath solubility limits and economic considerations dictate, usually no higher than about 1.5 mol per liter. A typical range is between about 0.005 and about 1 mol per liter of bath, preferably between about 0.1 and 0.7 mol per liter, especially when the complexing agent is a carboxylic acid.

These baths may optionally include stabilizers such as those of the carboxylic acid type, sources of antimony or of lead for controlling the sulfide ion content, or a sulfur containing compound such as thiourea or a combination thereof such as thiodiglycolic acid. Whenever a sulfur-containing compound is added, the sulfur content must be carefully controlled, since excessive sulfur will reduce the boron content of the deposit. Any such sulfur addition should be monitored so that the maximum sulfur concentration is about 20 ppm as divalent sulfur. Otherwise, when stabilizers are added to the bath, they are at a concentration typical for the particular compound.

Other compositions that may be included in this system at their typical bath concentrations include buffers, buffering systems, codepositions enhancers, and pH adjusting compounds such as strong bases. Polyalloy deposition may be accomplished by including bath-soluble compounds such as a complexing agent that is an ester complex prepared by reacting a polyhydric acid or alcohol with an oxyacid of the metal to be deposited as part of the polyalloy with nickel and boron or other metal.

In proceeding with the method according to this invention, a nickel-boron codeposit having a high boron content is laid down by deposition from a borane-reduced electroless nickel bath having a moderate pH and a moderate temperature, which bath includes a source of zirconyl and/or vandyl ions. The operational pH is less than 13, typically between 4 and 10, and in order to take the greatest advantage of the capabilities of this method to proceed under moderate conditions while still forming a high boron deposit, preferably the bath pH is maintained between about 5 and 7 while the temperature is maintained below 90° C., typically between about 60 and about 70° C. By such a method, nickel from the nickel source in the bath codeposits with boron from the reducing agent, this codeposit including in excess of 2 weight percent boron, based on the total weight of the deposit.

The method includes preparing an electroless deposition bath including a bath-soluble source of nickel, a bath-soluble borane reducing agent, a boron deposition enhancer that liberates vanadyl ions and/or zirconyl ions when added to the bath, preferably in combination with an electroless bath complexing agent. Preparing the bath may optionally include adding one or more stabilizers, sulfide-content controllers, buffers, buffering systems, polyalloy deposition sources, codeposition enhancers, and the like. Typically, it will be necessary to adjust the pH of the bath to within the desired moderate pH range, which is usually a strong base such as hydroxide to the bath, or when the pH becomes too high by adding a strong acid, such as sulfuric acid or other mineral acids.

Substrates to be deposited are immersed in the bath thus prepared. The weight or thickness of the nickel-boron codeposit laid down by the bath will vary, of course, with the plating rate and the length of time that the substrate is immersed within the bath. Plating rates according to this method are between about 0.2 and about 0.5 mil per hour, and typical tank loadings are between about 0.25 and 1.0 square foot per gallon of bath.

Products produced according to this invention include substrates, both metal and non-metal, that are plated with a protective coating of an electroless nickel-boron codeposit having a boron content of at least about 2 weight percent, which codeposit is laid down by a bath according to this invention. These products can have boron contents as high as or in excess of 5 weight percent, based on the weight of the deposit. Usually, the balance of the deposit will be nickel. Such plated codeposits exhibit an enhanced hardness, on the order of from 800 to 1000 $VHN_{50}$.

The following examples are offered to illustrate the present invention.

EXAMPLE I

An electroless bath was prepared to include 0.3 mol per liter of lactic acid, 0.08 mol per liter of citric acid, 0.04 mol per liter of dimethylamine borane, 0.01 mol per liter of zirconyl chloride octahydrate, 0.01 mol per liter of nickel, and enough ammonium hydroxide to maintain the pH at 6.0. The bath was raised to a temperature of 65° C., and a substrate was immersed therein, upon which there was formed a deposit of 4.1 weight percent boron and 95.9 weight percent nickel.

EXAMPLE II

Another electroless nickel deposition bath was prepared by adding the following to an aqueous bath: 0.3 mol per liter of lactic acid, 0.08 mol per liter of citric acid, 0.04 mol per liter of dimethylamine borane, 0.001 mol per liter of vanadyl sulfate, 0.1 mol per liter of nickel, and a concentration of ammonium hydroxide to raise the bath to a pH of 6.0 at a temperature of 70° C. A deposit composition was formed containing 3.6 weight percent boron and 96.4 weight percent nickel.

While in the foregoing specification certain embodiments and examples of this invention have been described in detail, it will be appreciated that modifications and variations therefrom will be apparent to those skilled in this art. Accordingly, this invention is to be limited only by the scope of the appended claims.

We claim:

1. An electroless nickel bath for laying down a nickel-boron deposit having a relatively high percentage of boron, said bath comprising an electroless nickel bath that excludes a borohydride and that is a borane-reduced bath including:

a bath-soluble source of nickel;

a bath-soluble borane reducing agent; and a bath-soluble boron deposition enhancing compound, said boron deposition enhancing compound being a source of ions selected from the group consisting of zirconyl ions, vanadyl ions, and combinations thereof, and said zirconyl or vanadyl ions remain substantially undeposited with the nickel-boron deposit.

2. The electroless bath of claim 1, wherein said boron deposition enhancing compound is a zirconyl salt or a vanadyl salt.

3. The electroless bath of claim 1, wherein said boron deposition enhancing compound is selected from the group consisting of zirconyl chloride, vanadyl sulfate, sodium metavanadate, and combinations thereof.

4. The electroless bath of claim 1, wherein said boron deposition enhancing compound is included within the bath at a concentration of at least about 0.0005 mol per liter, based on the total bath volue.

5. The electroless bath of claim 1, wherein said reducing agent is in amine borane or a cyclic amine borane.

6. The electroless bath of claim 1, wherein said borane reducing agent is included within the bath at a concentration of at least about 0.001 per liter, based on the total bath volume.

7. The electroless bath of claim 1, wherein said bath further includes a complexing agent at a concentration of at least about 0.0005 mol per liter, based on the total bath volume.

8. The electroless bath of claim 1, wherein said bath further includes a complexing agent, said complexing agent being a carboxylic acid or bath soluble derivatives thereof.

9. The electroless bath of claim 1, wherein said bath further includes a complexing agent, said complexing agent being a hydroxy-substituted carboxylic acid.

10. The electroless bath of claim 1, wherein said bath further includes a complexing agent, said complexing agent being an ester complex of an oxyacid and a polyhydric acid or alcohol.

11. The electroless bath of claim 1, wherein said bath further includes a complexing agent, said complexing agent being an organophosphoric complexing agent.

12. The electroless bath of claim 1, wherein said bath further includes a stabilizer.

13. The electroless bath of claim 1, wherein said bath further includes a buffer.

14. The electroless bath of claim 1, wherein said bath further includes a codeposition enhancer.

15. The electroless bath of claim 1, said bath being at a temperature of not greater than 90° C.

16. The electroless bath of claim 1, said bath being at a pH of less than 13.

17. The electroless bath of claim 1, said bath being at a pH of between about 5 and about 7.

18. A method for increasing the boron content of a nickel-boron electroless deposit, comprising immersing the substrate into an electroless nickel bath and depositing a nickel-boron deposit thereon, said bath including an electroless nickel bath that excludes a borohydride and that is a borane-reduced bath including:

a bath-soluble source of nickel;

a bath-soluble borane reducing agent; and a bath-soluble boron deposition enhancing compound, said boron deposition enhancing compound being a source of ions selected from the group consisting of zirconyl ions, vanadyl ions, and combinations thereof and said zirconyl or vanadyl ions remain substantially undeposited with the nickel-boron deposit.

19. The method of claim 18, wherein said bath is maintained at a temperature of not greater than 90° C.

20. The method of claim 18, wherein said bath is maintained at a pH of less than 13.

21. The method of claim 18, wherein said bath is maintained at a pH of between about 4 and about 10.

22. The method of claim 18, wherein said bath is maintained at a pH of between about 5 and about 7.

23. The method of claim 18, wherein said bath further includes a bath-soluble complexing agent.

24. The method of claim 18, wherein said depositing step lays down a deposit including at least about 2 weight percent boron, based on the total weight of the deposit.

* * * * *